US005847337A

United States Patent [19]

Chen

[11] Patent Number: 5,847,337

[45] Date of Patent: Dec. 8, 1998

[54] STRUCTURE OF COMPUTER KEYBOARD KEY SWITCH

[76] Inventor: Pao-Chin Chen, 4F, No. 292, Sec. 2, Chien Kuo S. Rd., Taipei, Taiwan

[21] Appl. No.: 891,411

[22] Filed: Jul. 9, 1997

[51] Int. Cl.[6] ..... H01H 3/12; H01H 13/70

[52] U.S. Cl. ..... 200/5 A; 200/344

[58] Field of Search ..... 200/5 A, 512, 200/517, 341, 344, 345; 400/490, 492.2, 495, 495.1

[56] References Cited

U.S. PATENT DOCUMENTS

| | | | |
|---|---|---|---|
| 4,771,146 | 9/1988 | Suzuki et al. | 200/5 A |
| 5,172,990 | 12/1992 | Weng | 400/490 |
| 5,457,297 | 10/1995 | Chen | 200/344 |
| 5,504,283 | 4/1996 | Kako et al. | 200/5 A |
| 5,625,532 | 4/1997 | Sellers | 200/344 |
| 5,630,501 | 5/1997 | Tsay | 200/344 |
| 5,695,047 | 12/1997 | Tanahashi | 200/344 |

*Primary Examiner*—Michael A. Friedhofer
*Attorney, Agent, or Firm*—Bacon & Thomas

[57] ABSTRACT

A computer keyboard key switch including a bottom support board, a key base having a rubber cone, a membrane circuit retained between the bottom support board and the key base, a bridging device supporting plate supported on the key base around the rubber cone, and a key cap coupled to the bridging device supporting plate by a bridging device, wherein the bottom support board has two upright lugs inserted through parallel slots on the membrane circuit and the key base and defining a respective retaining hole; the bridging device supporting plate has two coupling tongues respectively forced into engagement with the retaining holes of the upright lugs of the bottom support board.

2 Claims, 3 Drawing Sheets

STRUCTURE OF COMPUTER KEYBOARD KEY SWITCH

BACKGROUND OF THE INVENTION

The present invention relates to an improved structure of computer keyboard key switch, and more particularly to the coupling structure between the bridging device supporting plate and the bottom support board of the key switch.

U.S. patent application Ser. No. 08/230,128, now U.S. Pat. No. 5,457,297, discloses a computer keyboard key switch which includes a bottom support board, a membrane circuit supported on the bottom support board, a key base having a rubber cone and supported on the membrane circuit, a bridging device supporting board supported on the key base, a key cap, and a bridging device connected between the key cap and the bridge device supporting board and consisting of two rectangular open frames pivotably connected into a crossed form for permitting the key cap to be depressed to compress the rubber cone causing it to trigger the membrane circuit. This structure of computer keyboard key switch is functional, however because the bridging device supporting board is coupled to the key cap by the bridging device and not directly secured to the bottom support board, it tends to be pulled upwards from the key base upon each return stroke of the key cap.

SUMMARY OF THE INVENTION

The present invention has been accomplished to provide a computer keyboard key switch which eliminates the aforesaid drawback. According to the present invention, the computer keyboard key switch is comprised of a bottom support board, a membrane circuit, a key base having a rubber cone, a bridging device supporting plate, a bridging device, and a key cap, wherein the bottom support board has two upright lugs inserted through parallel slots on the membrane circuit and the key base and defining a respective retaining hole; the bridging device supporting plate has two coupling tongues respectively forced into engagement with the retaining holes of the upright lugs of the bottom support board.

DETAILED DESCRIPTION OF THE PREFERRED EMBODIMENT

Figure 1:
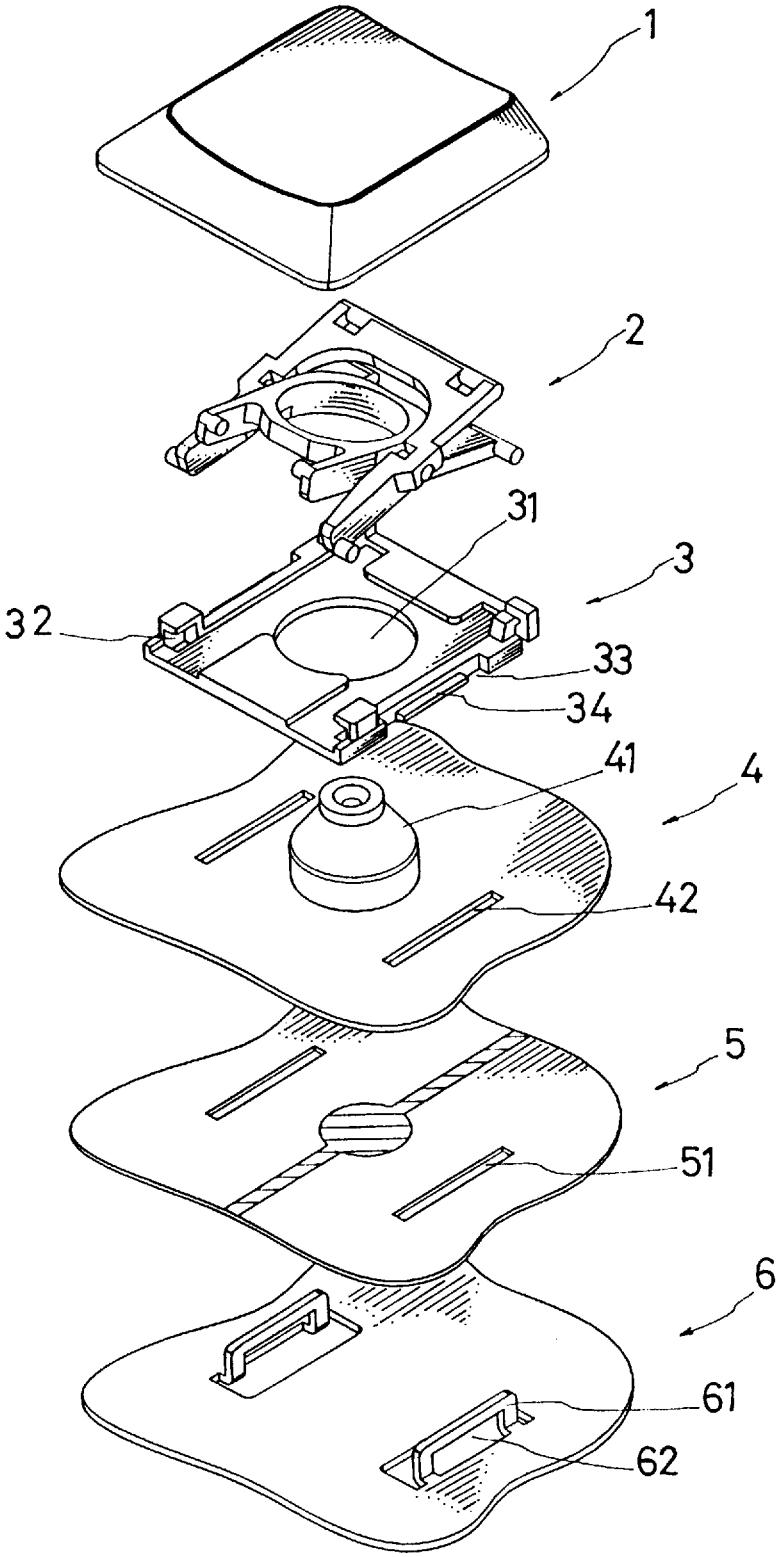
FIG. 1 is an exploded view of a computer keyboard key switch according to the present invention.
Figure 2:
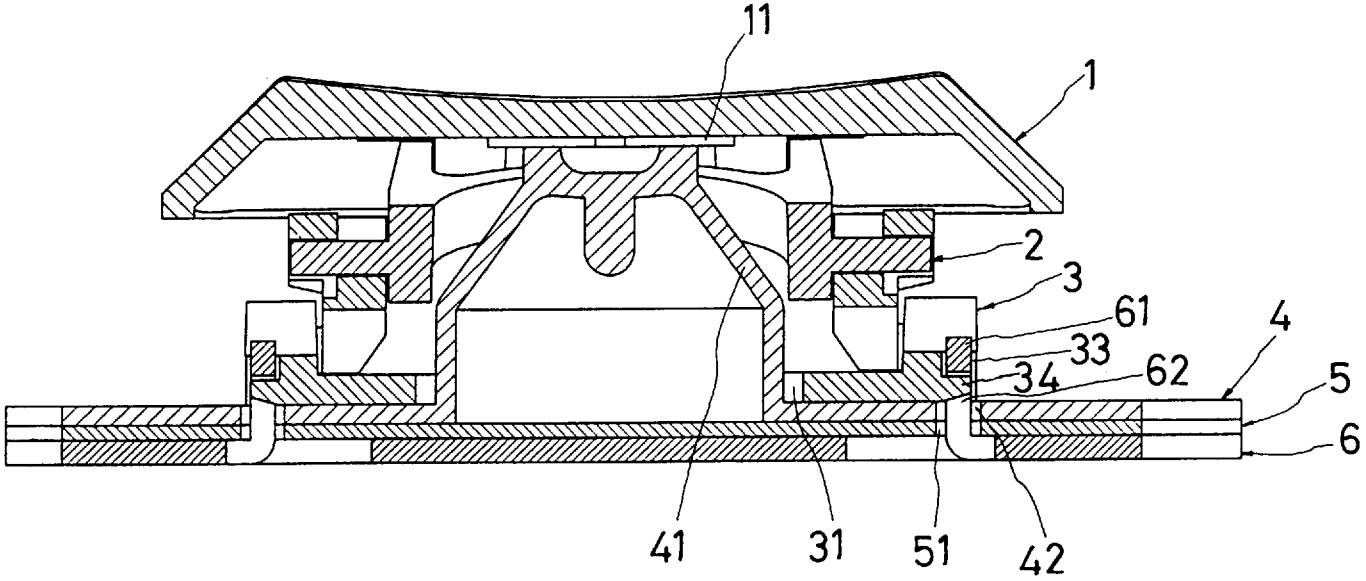
FIG. 2 is a sectional assembly view in an enlarged scale of the computer keyboard key switch shown in FIG. 1.
Figure 3:
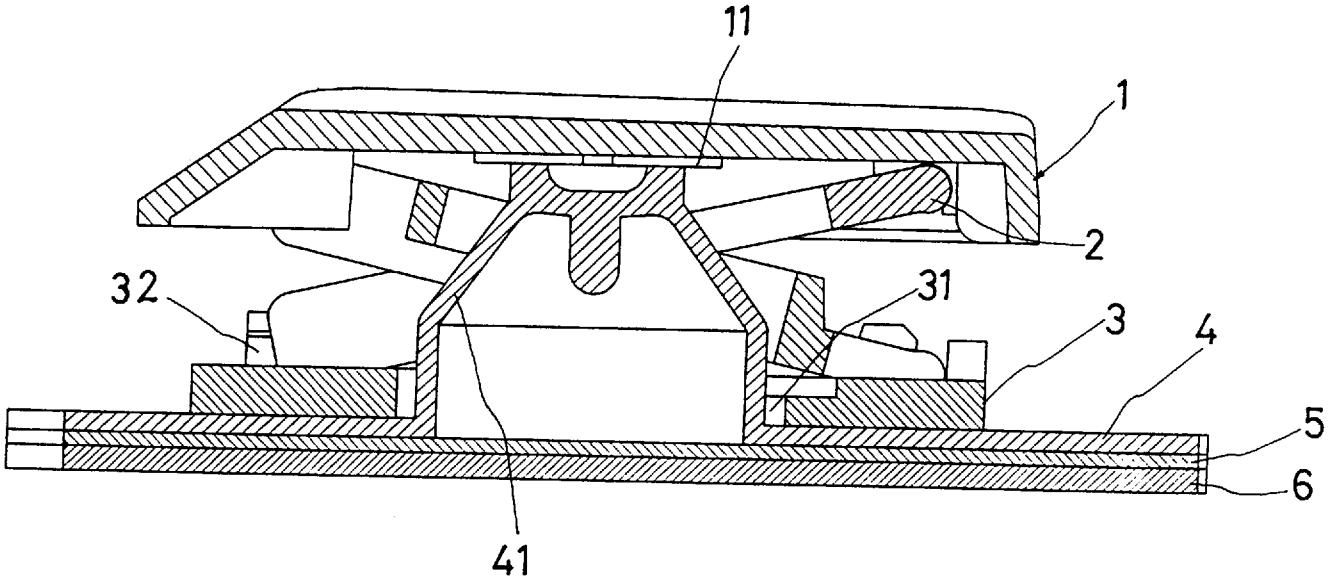
FIG. 3 is another sectional assembly view of the present invention when viewed from another angle.

Referring to FIGS. 1, 2 and 3, an improved structure of computer keyboard key switch in accordance with the present invention is generally comprised of a key cap 1, a bridging device 2, a bridging device supporting plate 3, a key base 4, a membrane circuit 5, and a bottom support board 6. The key cap 1 has a plunger 11 vertically extending downwardly from the center of its bottom side. The bridging device 2 is comprised of two rectangular open frames pivotably connected together into a crossed form, and coupled between the key cap 1 and the bridging device supporting plate 3. The bridging device supporting plate 3 comprises a center opening 31, four coupling portions 32 in four corners thereof respectively pivoted to the bridging device 2, two opposite side notches 33 at two opposite sides thereof, and two coupling tongues 34 respectively raised in the side notches 33. The key base 4 is molded from rubber or the like and supported on the membrane circuit 5 above the bottom support board 6, having a unitary rubber cone 41 protruding through the center opening 31 of the bridging device supporting plate 3, and two parallel slots 42 equally spaced from the rubber cone 41 at two opposite sides. The membrane circuit 5 is retained between the key base 4 and the bottom support board 6, having two parallel slots 51 respectively aligned with the parallel slots 42 of the key base 4. The bottom support board 6 comprises two upright lugs 61 made by stamping and defining a respective retaining hole 62 for engagement with the coupling tongues 34 of the bridging device supporting plate 3.

Referring to FIGS. 2 and 3, during the assembly process of the key switch, the upright lugs 61 of the bottom support board 6 are respectively inserted through the parallel slots 51 of the membrane circuit 5 and the parallel slots 42 of the key base 4, then the bridging device supporting plate 3 is supported on the key base 4 and secured in place by forcing the coupling tongues 34 of the bridging device supporting plate 3 into engagement with the retaining holes 62 of the lugs 61 of the bottom support board 6, and then the bridging device 2 is coupled between the key cap 1 and the bridging device supporting plate 3.

When assembled, the plunger 11 of the key cap 1 is supported on the rubber cone 41 of the key base 4. When the key cap 1 is depressed to lower the plunger 11, the rubber cone 41 is compressed by the plunger 11 to trigger the membrane circuit 5, causing the membrane circuit 5 to produce an electric signal to the computer. When the pressure is released from the key cap 1, the rubber cone 41 immediately returns to its former shape, causing the key cap 1 to return to its former position.

While only one embodiment of the present invention has been shown and described, it will be understood that various modifications and changes could be made thereunto without departing from the spirit and scope of the invention disclosed.

What the invention claimed is:

1. A computer keyboard key switch comprising a bottom support board, a key base having a rubber cone, a membrane circuit retained between said bottom support board and said key base, a bridging device supporting plate mounted on said key base around said rubber cone and secured to said bottom support board, a key cap supported on said rubber cone and depressed to compress said rubber cone in triggering said membrane circuit, and a bridging device coupled between said key cap and said bridging device supporting plate, wherein said key base has two parallel slots equally spaced from said rubber cone at two opposite sides; said membrane circuit has two parallel slots respectively aligned with the parallel slots of said key base; said bottom support board comprises two upright lugs respectively inserted through the parallel slots of said membrane circuit and the parallel slots of said key base and defining respective vertically disposed retaining holes; said bridging device supporting plate comprises two coupling tongues horizontally disposed at two opposite sides respectively forced into engagement with the vertically disposed retaining holes of said upright lugs.

2. The computer keyboard key switch of claim 1, wherein said coupling tongues of said bridging device supporting plate are respectively outwardly suspending in two opposite side notches of said bridging device supporting plate.

* * * * *